US010358317B2

(12) United States Patent
Laird et al.

(10) Patent No.: US 10,358,317 B2
(45) Date of Patent: Jul. 23, 2019

(54) CABLE TENSION MONITOR

(71) Applicant: The Chamberlain Group, Inc., Lombard, IL (US)

(72) Inventors: Edward Thomas Laird, Lombard, IL (US); Robert John Olmsted, Wood Dale, IL (US)

(73) Assignee: The Chamberlain Group, Inc., Oak Brook, IL (US)

( * ) Notice: Subject to any disclaimer, the term of this patent is extended or adjusted under 35 U.S.C. 154(b) by 0 days.

(21) Appl. No.: 14/755,820

(22) Filed: Jun. 30, 2015

(65) Prior Publication Data

US 2017/0002596 A1 Jan. 5, 2017

(51) Int. Cl.

| | |
|---|---|
| ***E06B 9/322*** | (2006.01) |
| ***B65H 75/44*** | (2006.01) |
| ***E05D 13/00*** | (2006.01) |
| ***E05D 15/24*** | (2006.01) |
| *E05F 15/686* | (2015.01) |

(52) U.S. Cl.

CPC ..... *B65H 75/4484* (2013.01); *E05D 13/1261* (2013.01); *E05D 15/24* (2013.01); *E05D 13/1269* (2013.01); *E05F 15/686* (2015.01); *E05Y 2201/654* (2013.01); *E05Y 2201/664* (2013.01); *E05Y 2201/672* (2013.01); *E05Y 2400/44* (2013.01); *E05Y 2400/502* (2013.01); *E05Y 2900/106* (2013.01)

(58) Field of Classification Search

CPC ..... E05F 15/41; E05F 2015/434; B65H 75/4484; E05Y 2201/672; B66D 3/24; B66D 1/36; B66D 1/46; B66D 1/48; B66D 1/485; B66D 1/50

USPC ..... 242/418.1, 420

See application file for complete search history.

(56) References Cited

U.S. PATENT DOCUMENTS

| | | | | |
|---|---|---|---|---|
| 647,242 | A | 4/1900 | Sprague | |
| 3,208,729 | A * | 9/1965 | Townsen | B66D 3/24 200/61.15 |
| 4,213,019 | A * | 7/1980 | Houp | E05D 13/00 200/47 |
| 4,305,513 | A | 12/1981 | Voelz | |

(Continued)

FOREIGN PATENT DOCUMENTS

| | | |
|---|---|---|
| WO | 2008048561 | 4/2008 |

OTHER PUBLICATIONS

Sensit Mineral Insulated Resistance Temperature Sensors, available Nov. 10, 2014, accessed Nov. 11, 2017 from http://www.sensit.cz/shop/en/mineral-insulated-resistance-temperature-sensors-mgo-diameter-6-mm/plastrtd6/plastrtd.html.*

*Primary Examiner* — Katherine W Mitchell
*Assistant Examiner* — Jeremy C Ramsey
(74) *Attorney, Agent, or Firm* — Fitch Even Tabin & Flannery LLP

(57) ABSTRACT

A sensor apparatus for a movable barrier system having a rotatable drum and an elongate member that winds up on and pays out from an external surface of the rotatable drum. The sensor apparatus includes a base portion, a sensing portion, and a controller. The sensing portion senses a first spaced apart proximity of the elongate member relative to the sensing portion and a second spaced apart proximity of the elongate member relative to the sensing portion. The controller detects a change in the proximity of the elongate member relative to the sensing portion without the elongate member contacting the sensing portion.

24 Claims, 5 Drawing Sheets

(56) References Cited

U.S. PATENT DOCUMENTS

| | | | | |
|---|---|---|---|---|
| 4,448,394 | A | 5/1984 | LeMoine | |
| 5,335,895 | A | 8/1994 | Sell | |
| 5,706,875 | A * | 1/1998 | Simon | E06B 9/88 160/1 |
| 5,803,149 | A | 9/1998 | Halley | |
| 5,960,849 | A | 10/1999 | Delaney | |
| 5,988,596 | A | 11/1999 | Mitchell | |
| 6,135,421 | A * | 10/2000 | Bartelme | B66D 3/24 254/268 |
| 6,142,448 | A | 11/2000 | Fujiwara | |
| 6,782,662 | B2 | 8/2004 | McCartney | |
| 6,883,579 | B2 | 4/2005 | Olmsted | |
| 7,063,306 | B2 * | 6/2006 | Sanders | B66D 1/485 254/361 |
| 8,590,209 | B1 | 11/2013 | Skotty | |
| 2009/0127527 | A1 * | 5/2009 | Hoffend, III | A63J 1/028 254/338 |
| 2012/0137585 | A1 | 6/2012 | Brown | |
| 2014/0250787 | A1 * | 9/2014 | Olmsted | E05F 15/70 49/31 |

* cited by examiner

CABLE TENSION MONITOR

TECHNICAL FIELD

The present disclosure generally relates to monitoring tension in an elongate member such as a cable. More specifically, the present disclosure relates to monitoring cable tension in movable barrier settings.

BACKGROUND

Movable barrier systems typically include an operator that selectively moves a movable barrier (such as a segmented or one-piece garage door, swinging gate, sliding gate, rolling shutter, and so forth) between an opened and a closed position along guide tracks. Such barrier systems often include a counterbalance system, typically either a torsion spring counterbalance system or an extension spring counterbalance system.

A torsion spring counterbalance system includes a shaft (sometimes referred to as a jack shaft or torsion shaft), one or more torsion springs coiled around and connected to the shaft, and one or more drums connected to the shaft. Associated with each drum is a cable attached at one end to the drum (typically at a notch or slot in the drum), and at the opposite end to the lower region of the door.

As the door is opened, the torsion spring exerts a rotational force on the shaft. Rotation of the shaft causes the cables to be pulled up and wound about the drums. Through the cables, the spring pulls against the lower region of the door, in effect, reducing the weight of the door. This assists the user (when the operator system is in manual mode) or the motorized barrier operator (when in automatic mode) with opening of the door. Similarly, as the door is lowered, the cables unspool from the drums and extend down with the closing door.

During proper closing of the barrier, sufficient tension is placed on the cables to hold the cables against the external surfaces of the drums. However, various events can cause slack in a cable, resulting in the cable unspooling (or "jumping") from the drum. For example, slack often occurs when the speed of the door is slower than that of the operator. This slowdown in the movement of the door often can be attributed to obstructions in the path of the door. Slack can also occur when a user attempts to manually open the door when the door is connected to the barrier operator. Abnormalities along the surface of the drum or guide track can also cause slack in the cable.

Slack in cables of movable barrier systems is particularly problematic. An unspooled (or "thrown") cable can become entangled or fall from the drum, rendering the counterbalance system inoperative. Slack in a cable may also result in uncontrolled downward acceleration of the door when, for example, an obstacle previously obstructing downward movement of the door is removed.

Resetting of thrown cables is time consuming and expensive, resulting in downtime and often necessitating a service call from a trained technician. In addition to the cables, the counterbalance system usually must also be reset.

Thus, it is advantageous to detect slack in the cable during operation of the movable barrier system, particularly before the cable becomes entangled or falls from the drum. It is further advantageous to stop the barrier operator from driving the barrier in the downward direction upon detection of slack in the cable.

Previous devices used to detect slack in a cable include mechanical components that must maintain a constant contact with the cable in order to detect slack in the cable. In this way, as the cables are wound up and paid out during normal operation of the barrier, they continuously rub against the mechanical components of the detection devices. Other devices are spaced away from the cable but detect slack in cables only upon contact of the cables against the devices. In both of these approaches, the cables necessarily contact the detection devices. Because cables are typically abrasive (having been typically formed of multi-strand steel), this contact damages the detection devices over time.

SUMMARY

Generally speaking, pursuant to these various embodiments, devices used in movable barrier settings can detect slack in a cable prior to contact of the cable against the devices. Upon detecting slack in the cable, the devices can signal to the movable barrier operator to stop and/or reverse motor energization to stop and/or reverse barrier movement.

These teachings are highly flexible in practice and will accommodate use in combination with a wide variety of sensors and movable barrier operators. It will be appreciated that such an approach can be readily deployed in conjunction with a wide variety of already-deployed movable barrier operators with little or no modification to the legacy equipment. These and other benefits may become clearer upon making a thorough review and study of the following detailed description.

Figure 1:
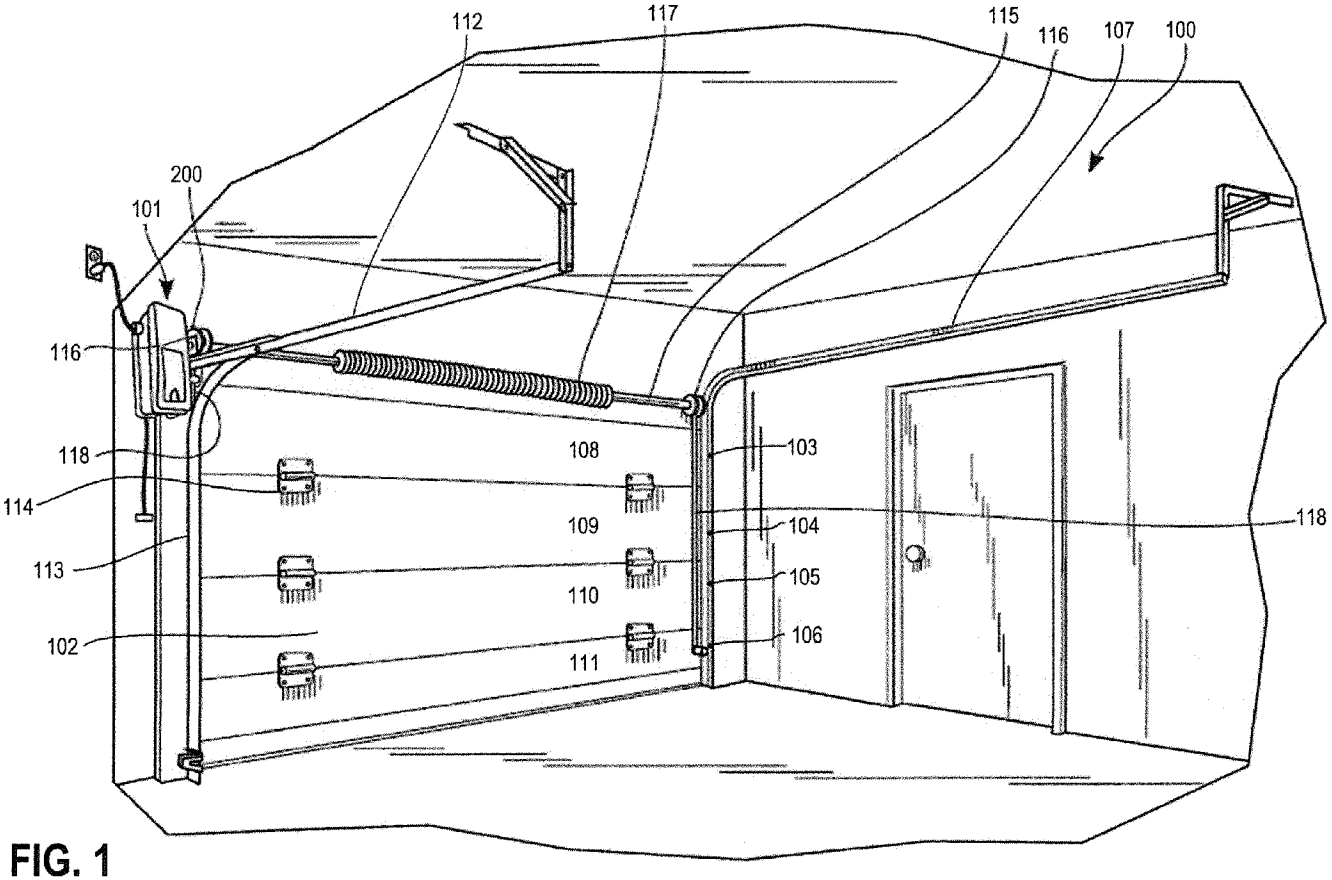
FIG. 1 comprises a perspective view illustrating an installation of an example movable barrier system.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking and pursuant to these various embodiments, a sensor apparatus is provided for a movable barrier operator having a rotatable drum configured to wind up and pay out an elongate member to at least support corresponding movement of a movable barrier connected to the elongate member.

Referring to the drawings, it may be helpful to first describe an illustrative application setting. It will be understood that the specifics of this example are intended to serve only in an illustrative regard and are not intended to express or suggest any corresponding limitations with respect to the scope of these teachings In the illustrative example shown in FIG. 1, a movable barrier system 100 comprises, in part, a movable barrier operator 101 positioned within a garage. The movable barrier operator 101 serves to control and effect selective movement of a multipanel garage door 102. The movable barrier operator 101 includes a motor (not shown) to provide motion to the garage door 102.

The illustrative example of FIG. 1 shows a jack shaft-style movable barrier operator 101 mounted to the wall of the garage. It should be noted that the movable barrier operator 101 may be located at any position relative to the garage door 102. For example, the movable barrier operator 101 may instead be a trolley operator that lifts and lowers the garage door 102 by pulling a carriage or trolley along a lift track using a chain, belt, or screw. In this example, the movable barrier operator 101 may be mounted to the ceiling of the garage. In yet another example, such as in a direct-drive opener system, the movable barrier operator 101 includes a motor that travels along a lift track to raise and lower the garage door 102.

The multipanel garage door 102 includes a plurality of rollers 103, 104, 105, 106 rotatably confined within a pair of tracks 107 positioned adjacent to and on opposite sides of the opening of the garage. The tracks 107 guide each segment 108, 109, 110, 111 of the garage door 102 as the door 102 is raised or lowered. The tracks 107 comprise a horizontal portion 112 generally parallel to the ceiling of the garage and a vertical portion 113 generally parallel to the door opening. The segments 108, 109, 110, 111 are connected to one another by hinges 114.

The movable barrier system 100 includes a counterbalance system. In the illustrative example shown in FIG. 1, a rotatable drive 115 (sometimes referred to as a torsion bar or jack shaft) is mounted above the opening of the garage. One or more rotatable drums 116 are positioned at either end of the rotatable drive 115. A torsion spring 117 is coiled around the rotatable drive 115 and exerts a rotational force on the rotatable drive 115.

The counterbalance system also includes at least one, and preferably two, elongate members that run along the sides of the garage door 102. In one approach, the elongate members are cables 118. Cables used in counterbalance systems typically are comprised of wound strands of galvanized steel. In other approaches, the elongate members may include chain, belt, rope, or combinations thereof. A cable 118 has a pair of opposed ends, with one end connected to a respective one of the rotatable drums 116 and the other end connected to the lower region of the garage door 102.

The interaction of the cables 118 and the rotatable drums 116 causes the rotatable drive 115 to rotate as the garage door 102 is raised or lowered. As the door 102 lowers, the cables 118 unspool (or "pay out") from the drums 116 and extend downwardly with the door 102. Similarly, as the door 102 is lifted, the cables 118 re-spool (or "wind up") around the drums 116. The torsion spring 117 exerts a rotational force on the rotatable drive 115 such that the drive 115 has a tendency to re-spool the cables 118. Through the cables 118, the spring 117 pulls against the lower region (e.g., segment 111) of the door 102, which makes it easier for the movable barrier operator 101 or human operator to raise the door 102. In effect, the arrangement of the torsion spring 117, rotatable drive 115, rotatable drums 116, and cables 118 reduce the weight of the door 102.

FIG. 1 shows a torsion spring counterbalance system. However, the teachings described herein are applicable to other known counterbalance systems, including for example, an extension spring counterbalance system.

Figure 2:
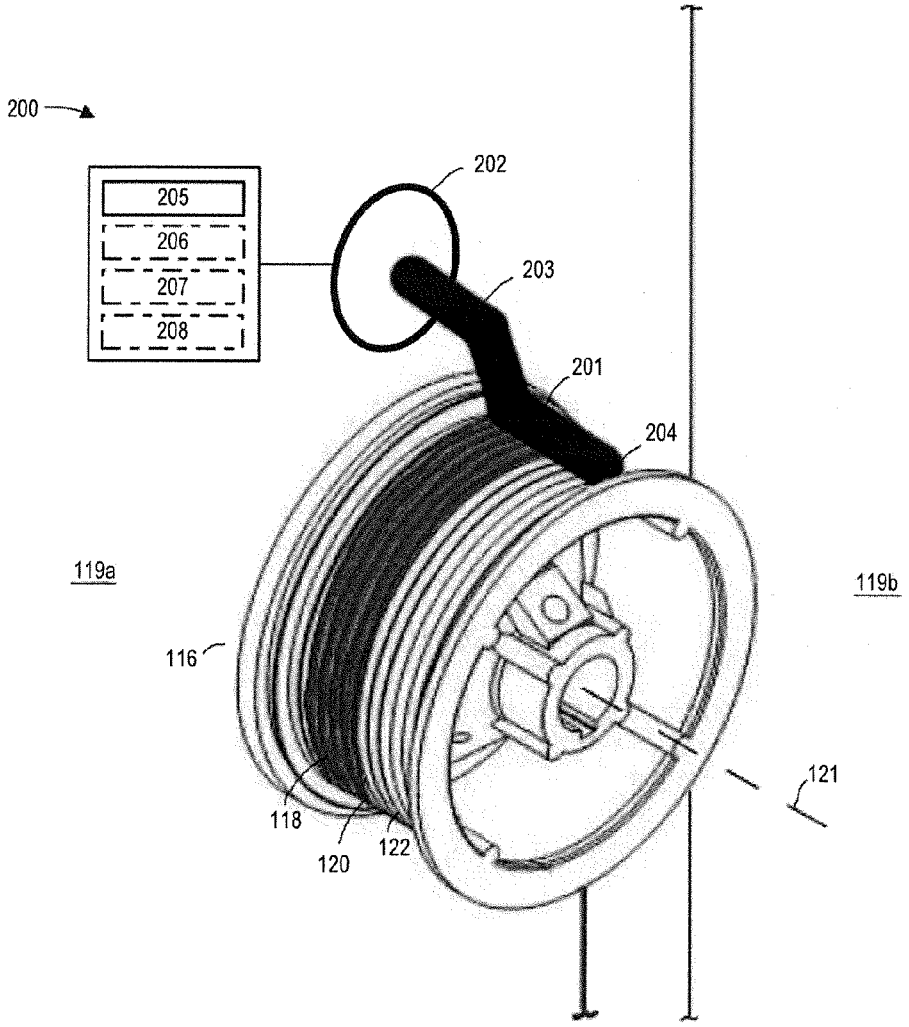
FIG. 2 comprises a perspective view of a first example sensor apparatus and drum for use in the movable barrier system of FIG. 1.
Figure 3:
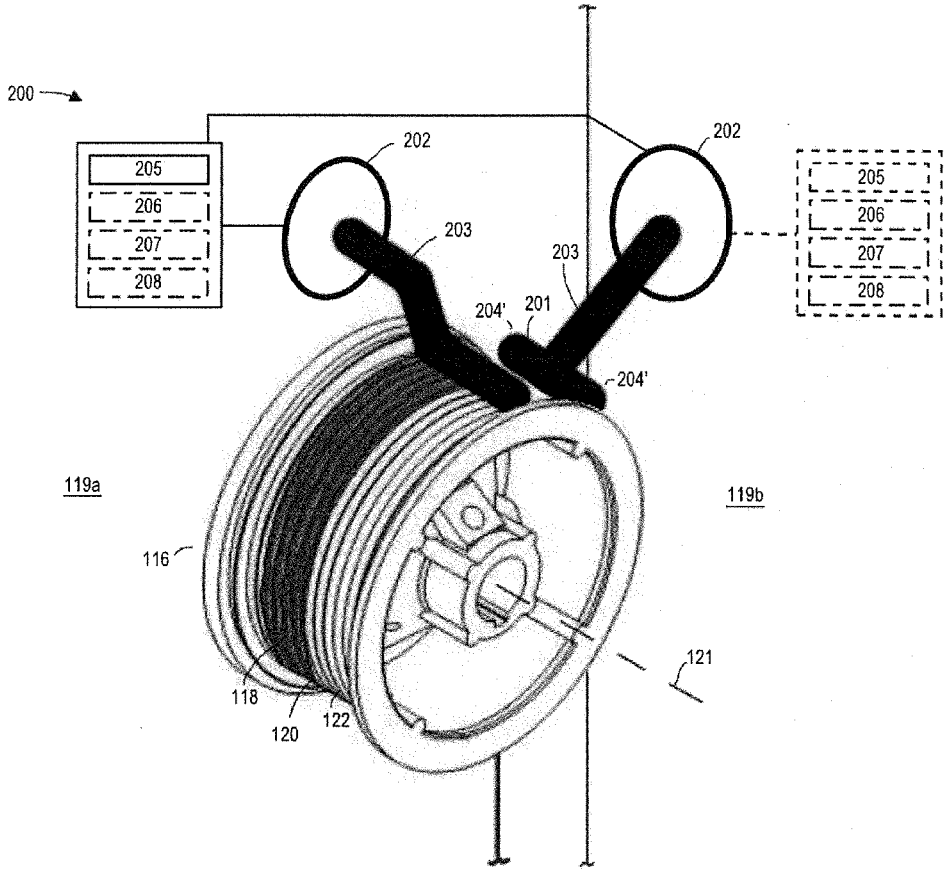
FIG. 3 comprises a perspective view of a second example sensor apparatus and drum for use in the movable barrier system of FIG. 1.

The movable barrier system 100 includes at least one sensor apparatus 200, shown in greater detail in FIGS. 2 and 3. In one approach, the movable barrier system 100 includes one sensor apparatus 200. In another approach, the movable barrier system 100 includes two sensor apparatuses 200 positioned at opposite ends of the rotatable drive 115.

The sensor apparatus 200 includes a sensing portion 201 and a base portion 202 for securing the sensing portion 201 to a surface of a garage (e.g., a side wall 119*a* in FIG. 2, front wall 119*b* in FIG. 3, or the ceiling (not shown)). The sensor apparatus 200 may also include an intermediary portion 203 between the base portion 202 and the sensing portion 201.

The sensing portion 201 may be a wire, rod, or the like. In a preferred approach, the sensing portion 201 is a capacitive sensor. With a capacitive sensor, the capacitance between the drum (ground) and the sensing portion 201 is measured, and changes in measured capacitance are detected. The measurement of capacitance at the sensing portion 201 may be accomplished using known techniques. Alternatively, the sensing portion is another type of sensor, including but not limited to an optical interrupter, an inductive sensor, or combinations thereof.

In one approach, the sensing portion 201 has at least one free end portion 204 that is not rigidly secured. In another approach, the sensing portion 201 may instead have two free end portions 204', as shown in FIG. 3. Having at least one free end portion 204 permits a user to shape the sensing portion 201, as discussed in greater detail below.

The base portion 202 may be a discrete component attached to the sensing portion 201, or may be a continuation of the sensing portion 201. In either approach, the base portion 202 is capable of supporting the sensing portion 201 after installation of the sensor apparatus 200.

In a first approach, shown in FIG. 2, the sensor apparatus 200 includes one sensing portion 201 connected to one base portion 202. In other approaches, the sensor apparatus 200 includes a plurality of sensing portions 201 connected to one or more base portions 202. An example of this approach is shown in FIG. 3. The plurality of sensing portions 201 may be radially spaced about a central longitudinal axis of the drum 121. The plurality of sensing portions 201 may installed on the same wall surface 119*a* or on different wall surfaces 119*a*, 119*b*, and may share operational components or may have discrete operational components.

In other approaches, the sensing portion 201 may take the form of a hood or sheath and may cover a greater portion of the circumferential perimeter of the drum 121 than a single sensing portion 201 shaped as a rod. Similar to the approach described with respect to a rod-shaped sensing portion 201, a hood or sheath detects slack in response to detecting a change in measured capacitance. Use of a hood or sheath allows the system to detect slack at multiple locations around the circumferential perimeter of the drum 121.

The sensor apparatus 200 also includes a controller 205 programmed and arranged to communicate with the sensing portion 201, as described in greater detail below. In some approaches, the sensor apparatus 200 includes a signal generator 206 and a signal transmitter 207. The sensor apparatus 200 also preferably includes a power supply 208 such as a battery to supply power to parts or all of the sensor apparatus 200. Some or all of operational components of the sensor apparatus (e.g., the controller 205, signal generator 206, signal transmitter 207, and power supply 208, shown schematically in FIGS. 2 and 3), may be housed within the sensing portion 201, within the base portion 202, or may be positioned away from the sensing portion 201 or base portion 202.

The sensor apparatus 200 is installed such that the sensing portion 201 is positioned sufficiently close to the drum 116 to so as to sense a proximity of the cable 118 relative to the sensing portion 201 when the cable 118 is wound up on the drum 116. The sensing portion 201 is positioned sufficiently close to the cable 118 to promptly detect a change in proximately of the cable 118, while also sufficiently spaced from the cable 118 so as to avoid "false" detections of slack in the cable 118. In one approach, the sensing portion 201 is positioned proximate to the drum 116 such that there is a space between the sensing portion 201 and the cable 118 of approximately ¼ inch to 1 inch when the cable 118 is wound up on the drum 116. In another approach, the sensing portion 201 is positioned proximate to the drum 116 such that there is a ½ inch space between the sensing portion 201 and the cable 118 when the cable 118 is wound up on the drum 116.

The sensing portion 201 may be installed such that the central longitudinal axis 209 of the sensing portion 201 lies within a plane tangential to the external surface 120 of the drum 116. The sensing portion 201 may also be installed such that it detects the proximity of the cable 118 at a plurality of sensing regions (such as a first sensing region 210 and a second sensing region 211 shown in FIGS. 4-6) along the central longitudinal axis 209 of the sensing portion 201.

The sensing portion 201 is also positioned such that it is radially spaced apart from the cable 118 so as not to contact the cable 118 during normal operation. This may be accomplished by spacing the sensing portion apart from the external surface 120 of the drum 116 by a sufficient distance so as not to contact the drum 116 or the cable 118 when the cable 118 is wound up on the drum 116. For example, the sensing portion 201 may be spaced apart from a receiving region, such as recessed grooves 122, of the external surface 120 of the drum 116 by a distance greater than a diameter of the cable 118.

As previously discussed, the sensing portion 201 senses information indicative of a proximity of the cable 118. In one approach, the sensing portion 201 senses information indicative of a proximity of the cable 118 as the cable 118 is paid out from the drum 116. In another approach, the sensing portion 201 also senses information indicative of a proximity of the cable 118 as the cable 118 is wound up on the drum 116. In yet another approach, the sensing portion 201 also senses information indicative of a proximity of the cable 118 when the movable barrier system 100 is idle. In this approach, the proximity of the cable 118 is continuously monitored. This allows the sensor apparatus 200 to detect slack during various slack-causing events, such collision of the door 102 with an obstacle during downward movement of the door 102, a vehicle contacting the door 102 during upward movement of the door 102, and manual opening of the door 102 during the idle phase.

During normal operation, the sensing portion 201 senses information indicative of a first spaced apart proximity of the cable 118 relative to the sensing portion 201. This first spaced apart proximity may be defined as the distance between the sensing portion 201 and the cable 118 when the cable 118 properly wound up on the drum 116. The cable 118 is properly wound up on the drum 116 when it is positioned between the sensing portion 201 and the external surface 120 of the drum 116, is in contact with the external surface 120 of the drum 116, and is not in contact with the sensing portion 201. A cable 118 is properly would up on a drum 116 when, for example, there is sufficient tension on the cable 118 to prevent the cable 118 from "jumping" from the external surface 120 of the drum 116.

Upon occurrence of a slack-causing event, however, the cable 118 is moved away from the external surface 120 of the drum 116 and closer to the sensing portion 201. The sensing portion 201 senses information indicative of a second spaced apart proximity of the cable 118 relative to the sensing portion 201. This second spaced apart proximity may be defined as the distance between the sensing portion 201 and the cable 118 when the cable 118 has "jumped" from the external surface 120 of the drum 116. The cable 118 has "jumped" when it is positioned between the sensing portion 201 and the external surface 120 of the drum 116, and is not in contact with the external surface 120 of the drum 116.

In one example, the second spaced apart proximity of the cable 118 relative to the sensing portion 201 is greater than zero; i.e., the cable 118 is not in contact with the sensing portion 201 when information indicative of the second spaced apart proximity is sensed by the sensing portion 201. In this example, the sensor apparatus 200 is able to detect a jumped cable 118 prior to the cable 118 contacting the sensing portion 201. This approach prevents wear on the sensing portion 201 and improves the lifespan of the sensing portion 201. In another example, the sensed proximity of the cable 118 relative to the sensing portion 201 is equal to zero; i.e., the cable 118 is in contact with the sensing portion 201.

The controller 205 receives information indicative of a proximity of the cable 118 relative to the sensing portion 201. Using this information, the controller 205 is able to detect changes in proximity of the cable 118 relative to the sensing portion 201. A change in proximity of the cable 118 relative to the sensing portion 201 may be a decrease in distance between the cable 118 and the sensing portion 201. In the example described above, the controller 205 detects the change in the proximity of the cable 118 relative to the sensing portion 201 in response to detecting the second spaced apart proximity sensed by the sensing portion 201 is less than the first spaced apart proximity sensed by the sensing portion 201. A reduction in the proximity of the cable 118 relative to the sensing portion 201 is indicative of slack in the cable 118.

The controller 205 is capable of detecting these changes in proximity without the cable 118 contacting the sensing portion 201. For example, where the sensing portion 201 is a capacitive sensor, the controller 205 receives information relating to the capacitance sensed at the sensing portion 201. As the distance between the sensing portion 201 and the cable 118 decreases, the capacitance increases. This increase in capacitance is measured. Using this information, the controller 205 is able to detect changes in capacitance sensed at the sensing portion 201 without the cable 118 contacting the sensing portion 201.

When a single controller 205 is used in conjunction with a plurality of sensing portions 201, the controller 205 detects changes in proximity of the cable 118 relative to the plurality of sensing portions 201.

The controller 205 may be configured to generate and transmit a signal indicating slack in the cable 118 in response to a defined slack detection event. In one approach, the defined slack detection event occurs when information received at the controller 205 is different than information expected to be received. For example, where the sensing portion 201 includes a capacitive sensor, the controller 205 receives information indicative of a change in capacitance as the cable 118 is wound up on the drum 116. During normal operation, the capacitance sensed at the sensing portion 201 gradually increases as more cable 118 is wound up on the drum 116. This normal increase in capacitance is received at the controller 205 and corresponds to capacitance information expected by the controller 205. However, upon occurrence of a slack-inducing event, the capacitance sensed at the sensing portion 201 may suddenly increase or decrease. This change in capacitance does not correspond to capacitance information expected by the controller 205. In one approach, a defined slack detection event occurs when this unexpected information is received at the controller 205. In another approach, a defined slack detection event occurs when the unexpected information received at the controller 205 exceeds a predefined threshold. In response, the controller 205 generates and transmits a signal indicating slack in the cable 118.

In another approach, the defined slack detection event is the detection of a change in proximity of the cable 118 relative to the sensing portion 201 that exceeds a predefined threshold. In this approach, the determination of slack in the cable 118 is made only after a second sensed spaced apart proximity is a predefined distance less than a first sensed space apart proximity. In another approach, the defined slack detection event is a plurality of consecutive detections of change in proximity of the cable 118 relative to the sensing portion 201. In this approach, the controller 205 generates and transmits a signal indicating slack in the cable 118 in response to the sensing portion 201 sensing a first spaced apart proximity of the cable 118, a second spaced apart proximity of the cable 118 that is less than the first spaced apart proximity (i.e., a first change in proximity), and a third spaced apart proximity of the cable 118 that is less than the second spaced apart proximity (i.e., a second change in proximity).

The defined slack detection events reduce the potential for a false detection of slack in the cable 118. Such a false detection may occur when abnormalities in the external surface 120 of the drum 116 or in the cable 118 cause a decrease in the proximity of the cable 118 relative to the sensing portion 201, despite the cable 118 being properly wound up on the drum 116. The defined slack detection events also prevent the controller 205 from signaling the movable barrier operator 101 when the slack in the cable 118 is insignificant to the operator of the movable barrier system 100.

In response to determining slack in the cable 118, the controller 205 preferably communicates with the movable barrier operator 101 so that the movable barrier operator 101 can respond accordingly. The controller 205 accomplishes this communication by generating (or instructing a signal generator 206 to generate) and transmitting (or instructing a signal transmitter 207 to transmit) a wired or wireless communication to the movable barrier operator 101.

The movable barrier operator 101 has an interface (not shown) capable of receiving wired or wireless communications from the controller 205. In one approach, in response to receiving a signal indicating slack in the cable 118, the movable barrier operator 101 stops the movement of the movable barrier 102. This prevents the cable 118 from further unraveling or falling from the drum 116. Stopping movement in the downward direction also reduces the risk of uncontrolled downward acceleration of the movable barrier 102. The movable barrier operator 101 may also be configured to reverse movement of the movable barrier 102, for example, by raising a previously-downward moving movable barrier 102. Raising the movable barrier 102 in the upward direction serves to take up excess slack in the cable 118.

In another approach, in response to receiving a signal indicating slack in the cable 118, the movable barrier operator 101 does not operate in response to receiving a user command. For example, where a user manually raised a door 102 while the movable barrier system 100 was in idle mode, thus causing slack in the cable, the controller 205 generates and transmits a communication to the movable barrier operator 101. In response to receiving the signal, the movable barrier operator 101 will not implement a user command to open or close the door 102. The movable barrier operator 101 may continue to ignore user commands until the operator 101 receives an "all clear" signal from the sensor apparatus 200, or until the operator 101 receives confirmation (such as through a user input) that the system has been inspected.

In addition, or in the alternative, to communicating with the movable barrier operator 101 in response to determining slack in the cable 118, the sensor apparatus 200 may alert a user of the slack. This may be accomplished through an annunciation system associated with the sensor apparatus 200. The annunciation system may include one or more speakers, lights, or display screens, or any combination thereof, to provide a user a visual and/or audible alert. Preferably, the visual and/or audio alert is of a volume or intensity sufficient to be perceived by a user located away (such as 10 feet or more) from the sensor apparatus 200. In some settings, a combination of audio and visual feedback is preferable.

Because the sensor apparatus 200 described herein detects slack prior to the cable 118 contacting the sensing portion 201, the risk of the cable 118 contacting the sensing portion after a slack-causing event is significantly reduced. Wear on sensing portion over time is thus reduced, extending the operational life of the sensor apparatus 200.

In a preferred approach, the sensing portion 201 is a shapeable. As used herein, "shapeable" refers to a sensing portion 201 that is sufficiently pliable to be manipulated, and that holds its new shape after it is manipulated. In one approach, the shapeable sensing portion 201 can be manipulated by the user using only basic hand tools. In another approach, the shapeable sensing portion 201 can be manipulated "by hand"; that is, without the need for a user to use any tools. Shaping of the sensing portion 201 may be accomplished through bending or twisting. In one example, the shapeable portion 201 is an exposed wire of an appropriate gauge. In another example, the shapeable portion 201 is a flexible conductive material, such as gooseneck tubing or other metal tubing. The installer may form the wire or tubing (for example, with plyers or "by hand") to be a desired distance from the drum 116. In addition to the sensing portion 201, the base portion 202 or intermediary portion 203 may also be adjusted to position or orient the sensing portion 201 in proximity to the cable 118.

Figure 4:
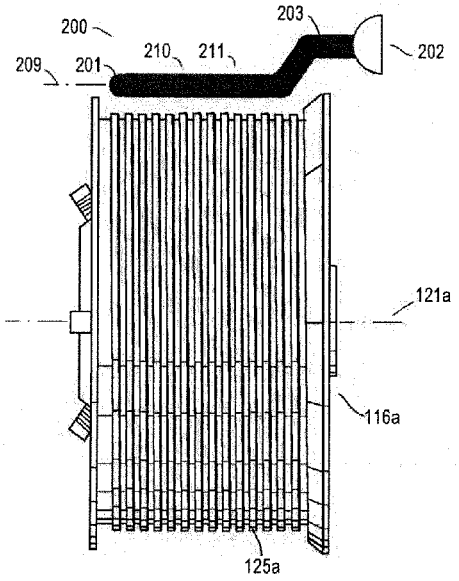
FIG. 4 comprises an elevational view of an example sensor apparatus and drum that may be used in conjunction with the movable barrier system.
Figure 5:
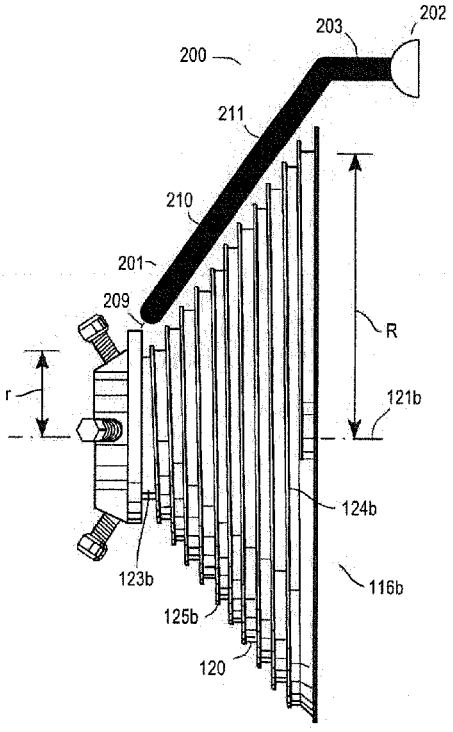
FIG. 5 comprises another elevational view of an example sensor apparatus and drum that may be used in conjunction with the movable barrier system.
Figure 6:
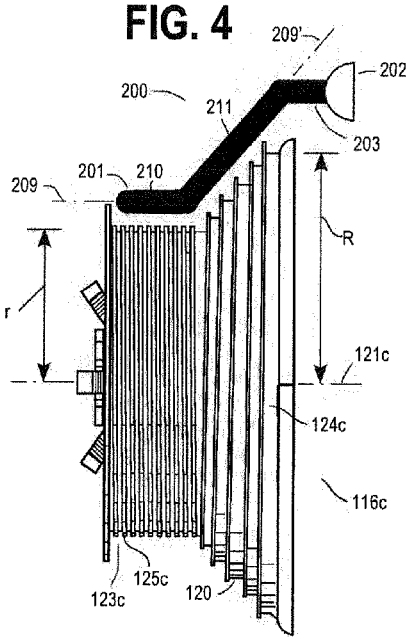
FIG. 6 comprises another elevational view of an example sensor apparatus and drum that may be used in conjunction with the movable barrier system.

A shapeable sensing portion 201 allows a user to retrofit the sensor apparatus 200 for use with various drums 116 having different drum profiles. As shown in FIGS. 4-6, each drum 116*a*, 116*b*, 116*c* has a drum profile defined by the external surface 120 of the drum. The external surface 120 is capable of receiving a cable 118 when the cable 118 is wound up on the drum 116. The external surface 120 receives the cable 118 in receiving regions formed in the external surface 120. These receiving regions are typically helical recesses in the form of grooves 122 (shown in FIG. 2), or recesses between raised regions 125*a*, 125*b*, 125*c* (shown in FIGS. 4-6). The recessed grooves 122 and raised portions 125*a*, 125*b*, 125*c* serve to prevent lateral movement of the cable 118 when the cable 118 is wound up on the drum 116.

As also shown in FIGS. 4-6, a drum profile is also defined by the radius of the external surface 120 of the drum 116. For example, a drum 116*a* , shown in FIG. 4, having a generally constant radius along the longitudinal axis 121*a* is typically used in a residential movable barrier system. Other applications, such as industrial movable barrier systems, may utilize drums having other drum profiles. For example, the drum 116*b* of FIG. 5 includes a startup portion 123*b* having a relatively small radius r. The radius of the external surface 120 of the drum 116*b* gradually increases along the longitudinal axis 121*b* of the drum 116*b* until reaching a lock out portion 124*b* having a relatively large radius R. The drum 116*c* of FIG. 6 includes a cylindrical startup portion 123*c* with a generally constant radius r, and a radially enlarged lockout portion 124*c* with a relatively larger radius R.

Because the sensing portion 201 is shapeable, a user can shape the sensing portion 201 to complement the profile of a drum 116. As used herein, the sensing portion 201 complements the profile of a drum 116 such that when it is shaped, the sensing portion 201 maintains a generally constant proximity to the external surface 120 of the drum 116 along the central longitudinal axis 209 of the sensing portion 201 regardless of changes in diameter of the drum 116 along the central longitudinal axis 121 of the drum 116.

As previously discussed, the sensing portion 201 can detect the proximity of the cable 118 at a plurality of sensing regions along the central longitudinal axis 209 of the sensing portion 201. Because it is shapeable, a user can shape the sensing portion 201 to complement the external surfaces 120 of various drum profiles such that the sensing portion 201 detects the proximity of the cable 118 at a first sensing region 210 and at a second sensing region 211. Depending on the drum profile, the first and second sensing regions 210, 211 may be collinear along the central longitudinal axis 209 of the sensing portion 201 (as shown in FIGS. 4 and 5), or may be angularly offset along central longitudinal axis 209 and central longitudinal axis 209', respectively (as shown in FIG. 6).

The sensor apparatus 200 described herein advantageously reduces wear on the sensing portion 201, and is adaptable so as to be retrofit for use with a wide variety of drums 116 having different drum profiles.

Figure 7:
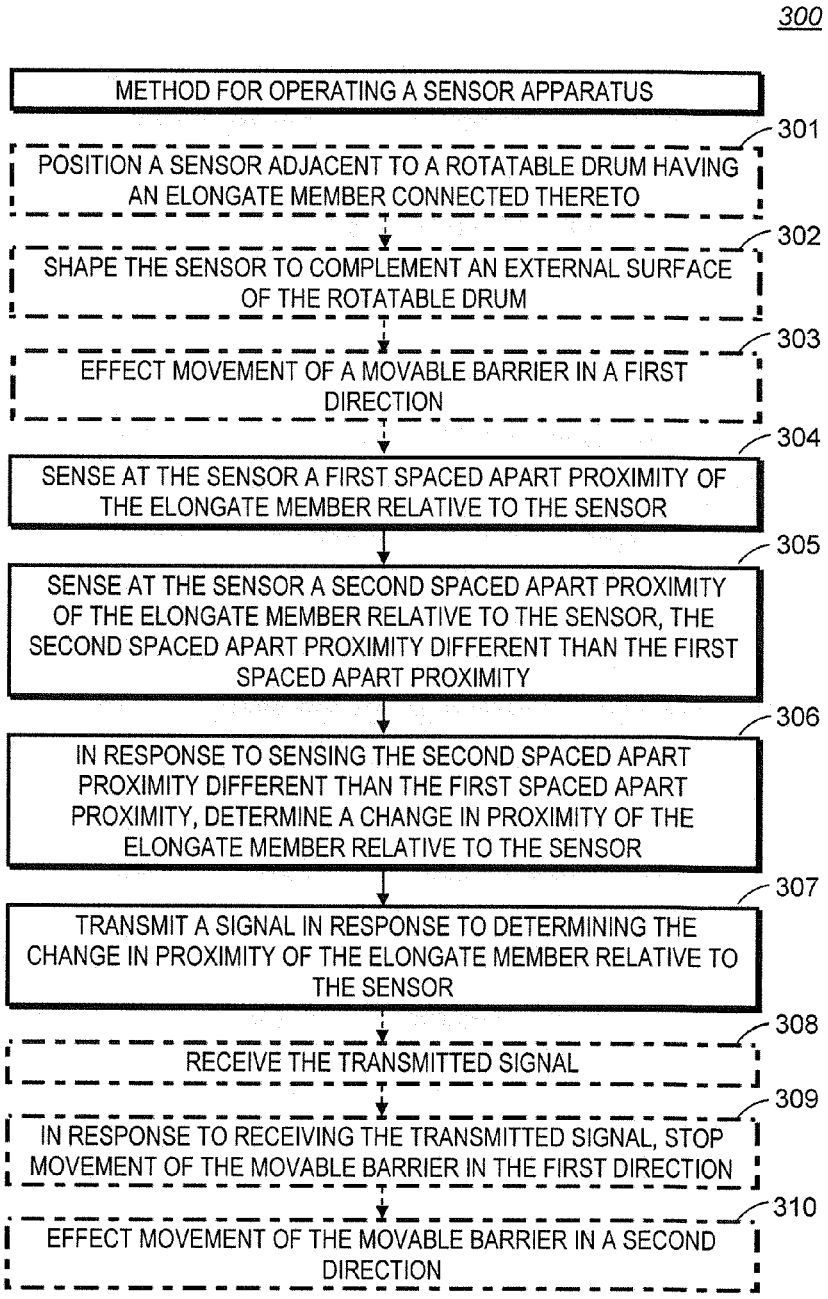
FIG. 7 comprises a flow diagram of an example method of operation of a sensor apparatus in accordance with various embodiments of the invention.

With reference to FIG. 7, an example method 300 of operating the sensor apparatus 200 is disclosed. The method 300 optionally includes positioning 301 a sensor adjacent to a rotatable drum having an elongate member connected thereto and shaping 302 the sensor to complement an external surface of the rotatable drum. The method 300 also optionally includes effecting 303 movement of a movable barrier in a first direction.

The method 300 includes sensing 304 at the sensor a first spaced apart proximity of an elongate member relative to the sensor. The method 300 further includes sensing 305 at the sensor a second spaced apart proximity of the elongate member relative to the sensor, the second spaced apart proximity different than the first spaced apart proximity. In a preferred approach, the second spaced apart proximity is less than the first spaced apart proximity. In response to sensing the second spaced apart proximity different than the first spaced apart proximity, the method includes determining 306 a change in proximity of the elongate member relative to the sensor. The method 300 also includes transmitting 307 a signal in response to determining the change in proximity of the elongate member relative to the sensor.

In one approach, the method 300 further includes receiving 308 the transmitted signal and, in response to receiving the transmitted signal, stopping 309 movement of the movable barrier in the first direction. In yet another approach, the method 300 further includes in response to receiving the transmitted signal, effecting 310 movement of the movable barrier in a second direction.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

What is claimed is:

1. A sensor apparatus for a movable barrier system including a rotatable drum and an elongate member that winds up on and pays out from an external surface of the rotatable drum, the sensor apparatus comprising:

a base portion for securing to a mounting surface;

an elongate intermediate portion connected to the base portion and extending away from the base portion;

a pair of sensing portions connected to the elongate intermediate portion and extending in different directions away from the elongate intermediate portion with each sensing portion having a free end portion spaced from the elongate intermediate portion;

the sensing portions spaced from the external surface of the rotatable drum and configured to sense a proximity of the elongate member relative to the sensing portions; and a controller operably connected to the sensing portions, the controller configured to detect a change in the proximity of the elongate member relative to at least one of the sensing portions without the elongate member contacting the at least one sensing portion, the controller further configured to effect a reversal of rotational direction of the rotatable drum in response to the controller detecting a change in proximity of the elongate member relative to the at least one sensing portion; and wherein the sensing portions are shapeable to complement the external surface of the rotatable drum so that the sensing portions have a generally constant distance from the external surface of the rotatable drum.

2. The sensor apparatus of claim 1, wherein the sensing portions are spaced apart from a receiving region of the external surface of the rotatable drum by a distance greater than a diameter of the elongate member.

3. The sensor apparatus of claim 1, wherein one sensing portion of the pair of sensing portions is configured to sense a first spaced apart proximity of the elongate member relative to the one sensing portion and a second spaced apart proximity of the elongate member relative to the one sensing portion, and wherein the first spaced apart proximity is a first distance between the one sensing portion and the elongate member when the elongate member is positioned between the one sensing portion and the external surface of the rotatable drum, is in contact with the external surface of the rotatable drum, and is not in contact with the one sensing portion.

4. The sensor apparatus of claim 1, wherein one sensing portion of the pair of sensing portions is configured to sense a first spaced apart proximity of the elongate member relative to the one sensing portion and a second spaced apart proximity of the elongate member relative to the one sensing portion, and wherein the second spaced apart proximity is a second distance between the one sensing portion and the elongate member when the elongate member is positioned between the one sensing portion and the external surface of the rotatable drum, is not in contact with the external surface of the rotatable drum, and is not in contact with the one sensing portion.

5. The sensor apparatus of claim 1, wherein the change in proximity of the elongate member relative to the sensing portion is a decrease in distance between the elongate member and one of the sensing portions.

6. The sensor apparatus of claim 1, wherein one of the sensing portions is configured to sense a first spaced apart proximity of the elongate member relative to the one sensing portion and a second spaced apart proximity of the elongate member relative to the one sensing portion, and wherein the controller detects the change in the proximity of the elongate member relative to the one sensing portion in response to detecting the second spaced apart proximity sensed by the one sensing portion is less than the first spaced apart proximity sensed by the one sensing portion.

7. The sensor apparatus of claim 1, further comprising a signal generator configured to generate a signal in response to the controller detecting the change in proximity of the elongate member relative to the at least one sensing portion.

8. The sensor apparatus of claim 1, further comprising a signal transmitter configured to transmit a signal in response to the controller detecting the change in proximity of the elongate member relative to the at least one sensing portion.

9. The sensor apparatus of claim 1, wherein the sensing portions are shapeable by hand.

10. The sensor apparatus of claim 1, wherein the at least one sensing portion is configured to detect a proximity of the elongate member relative to the at least one sensing portion at a plurality of sensing regions along a central longitudinal axis of the at least one sensing portion.

11. The sensor apparatus of claim 10, wherein the plurality of sensing regions comprises a first sensing region and a second sensing region, the first sensing region angularly offset with respect to the second sensing region.

12. The sensor apparatus of claim 1, further comprising a third sensing portion configured to sense a proximity of the elongate member relative to the third sensing portion.

13. The sensor apparatus of claim 12, wherein the third sensing portion is spaced about a central longitudinal axis of the drum from the pair of sensing portions.

14. The sensor apparatus of claim 1, wherein the sensing portions include a device being selected from the group consisting of:

a capacitive sensor, an optical interrupter, an inductive sensor, and combinations thereof.

15. The sensor apparatus of claim 1, wherein the sensing portions are straight.

16. The sensor apparatus of claim 1 in combination with the rotatable drum, wherein the rotatable drum includes a conical portion having the external surface thereon.

17. The sensor apparatus of claim 1, wherein the elongate intermediate portion and the sensing portions have a T-shaped configuration.

18. A movable barrier system comprising:

a movable barrier operator configured to move a movable barrier in a first direction and a second direction;

an elongate member capable of being connected to the movable barrier;

a rotatable drum rotatable about an axis and having an external surface configured to receive the elongate member thereon, the external surface extending about the rotatable axis and having a predetermined width along the axis;

the elongate member configured to wind up on and pay out from the external surface of the rotatable drum to at least support corresponding movement of the movable barrier; and a sensor apparatus comprising:

a base portion for securing to a mounting surface;

a sensing portion connected to the base portion and configured to extend substantially the entire width of the external surface of the rotatable drum, the sensing portion configured to sense a proximity of the elongate member relative to the sensing portion at a plurality of sensing regions along a central longitudinal axis of the sensing portion, wherein the sensing portion is shapeable to complement the external surface of the rotatable drum so that the sensing portion has a generally constant distance from the external surface of the rotatable drum; and a controller connected to the sensing portion, the controller configured to receive information from the sensing portion to detect a change in the proximity of the elongate member relative to any of the sensing regions along the width of the external surface of the rotatable member without the elongate member contacting the sensing portion, wherein the controller is further configured to effect a reversal of rotational direction of the rotatable drum in response to the controller detecting a change in proximity of the elongate member relative to the sensing portion according to the information received from the sensing portion.

19. The movable barrier system of claim 18, wherein the movable barrier operator is configured to stop movement of the movable barrier in the first direction in response to the sensor apparatus detecting the change in proximity of the elongate member relative to the sensing portion without the elongate member contacting the sensing portion.

20. The movable barrier system of claim 18, wherein the movable barrier operator is configured to move the movable barrier in the second direction in response to the sensor apparatus detecting the change in proximity of the elongate member relative to the sensing portion without the elongate member contacting the sensing portion.

21. The movable barrier system of claim 18 wherein the rotatable drum includes a conical portion having the external surface thereon.

22. A method comprising:

shaping a first sensing portion and a second sensing portion of a sensor to complement an external surface of at least one of a cylindrical portion and a conical portion of a rotatable drum such that the first sensing portion and the second sensing portion each have a generally constant distance from the external surface of the rotatable drum and the first sensing portion and the second sensing portion are circumferentially spaced apart from each other about the external surface of the rotatable drum;

sensing by the sensor a first spaced apart proximity of an elongate member connected to the rotatable drum relative to the sensor;

sensing by the sensor a second spaced apart proximity of the elongate member relative to the sensor, the second spaced apart proximity different than the first spaced apart proximity;

in response to sensing the second spaced apart proximity different than the first spaced apart proximity, determining a change in proximity of the elongate member relative to the sensor;

transmitting a signal in response to determining the change in proximity of the elongate member relative to the sensor; and reversing direction of the rotatable drum in response to the signal.

23. The method of claim 22, further comprising:

effecting movement of a movable barrier in a first direction;

receiving the transmitted signal; and in response to receiving the transmitted signal, stopping movement of the movable barrier in the first direction.

24. The method of claim 22 wherein shaping the first sensing portion and the second sensing portion of the sensor to complement the external surface of the at least one of the cylindrical portion and the conical portion of the rotatable drum includes shaping the first sensing portion and the second sensing portion to complement the external surface of both a cylindrical portion and a conical portion of the rotatable drum.

* * * * *